United States Patent [19]

Paradowski

[11] 4,334,902

[45] Jun. 15, 1982

[54] METHOD OF AND SYSTEM FOR REFRIGERATING A FLUID TO BE COOLED DOWN TO A LOW TEMPERATURE

[75] Inventor: Henri Paradowski, Cergy Pontoise, France

[73] Assignee: Compagnie Francaise d'Etudes et de Construction "Technip", Paris La Defense, France

[21] Appl. No.: 213,164

[22] Filed: Dec. 4, 1980

[30] Foreign Application Priority Data

Dec. 12, 1979 [FR] France ..... 79 30490

[51] Int. Cl.[3] ..... F25J 1/02

[52] U.S. Cl. ..... 62/9; 62/114; 62/40; 62/38; 62/402

[58] Field of Search ..... 62/38, 39, 40, 9, 114, 62/402

[56] References Cited

U.S. PATENT DOCUMENTS

| | | | |
|---|---|---|---|
| 3,383,873 | 5/1968 | Becker | 62/38 |
| 3,690,114 | 9/1972 | Swearingen et al. | 62/40 |
| 3,735,600 | 5/1973 | Dowdell et al. | 62/39 |
| 4,094,655 | 6/1978 | Krieger | 62/40 |

FOREIGN PATENT DOCUMENTS

| | | |
|---|---|---|
| 2049181 | 10/1970 | Fed. Rep. of Germany . |
| 1303516 | 7/1961 | France . |
| 2128674 | 3/1972 | France . |
| 2409469 | 11/1977 | France . |

*Primary Examiner*—Norman Yudkoff

*Attorney, Agent, or Firm*—Kenyon & Kenyon

[57] ABSTRACT

A process of and an apparatus for saving energy in a method of liquefying a natural gas by cooling same with the vapor from a liquid coolant sub-cooled after expansion thereof in the liquid condition, the vapor simultaneously sub-cooling the liquefied coolant, the process consisting in expanding the sub-cooled high-pressure liquid coolant in a hydraulic turbine providing mechanical power possibly for driving a rotary machine.

14 Claims, 5 Drawing Figures

METHOD OF AND SYSTEM FOR REFRIGERATING A FLUID TO BE COOLED DOWN TO A LOW TEMPERATURE

The present invention relates generally to a method of and a system for refrigerating a fluid to be cooled down to a low temperature; more particularly it deals with and has essentially for its subject matter a process of saving energy and possibly initial capital expenditure and original cost in a method of refrigerating at least one fluid to be cooled down to a low temperature, lower than a presently preferred value of −30° C. and in particular of a gaseous fluid to be liquefied such as in particular a natural or synthetic gas as for instance a methane-rich gas, as well as an apparatus for carrying out this process. The invention is also directed to the various applications and uses resulting from putting said process and/or apparatus into practice as well as to the devices, assemblies, arrangements, equipments, plants, facilities and like installations provided with such apparatus.

There are known methods of and systems for refrigerating fluids to be cooled and in particular liquefying low temperature gases, wherein it is possible in particular by passing the fluids through suitable heat exchangers to obtain the condensation at high pressure and low temperature of natural or synthetic gases and then the sub-cooling at high pressure of the liquefied gases and afterwards the expansion in a valve before recovering for instance the liquefied gases in a collecting vessel or storage tank at low pressure. It is also known to use, for performing the refrigerating step, methods wherein the refrigerating or cold-generating fluid or fluids are condensed at low temperature and high pressure and wherein the liquid refrigerating fluid or fluids are sub-cooled at very low temperature and at high pressure and are then expanded in valves and vaporized at low pressure.

A main object of the present invention is to improve this known state of the prior art in particular with a view to decrease the power consumed by the compressors for the refrigerating fluids with respect to a same amount of treated products, thereby reducing the cost of the treatment. For this purpose the invention provides a process of saving energy and possibly initial cost in a method of refrigerating at least one fluid to be cooled down to a low temperature, lower than a presently preferred value of −30° C., such as in particular but not exclusively a method of liquefying a gas through heat exchange with a single refrigerating fluid or with a refrigerating fluid which is part of a system of several refrigerating fluids evolving according to individual cycles, respectively, combined into a cold-generating cascade for instance of an incorporated type or equivalent to successive temperature drops; the or each refrigerating fluid then consists of a mixture of several different component substances and evolves according to a closed-loop cooling cycle while undergoing therein successively: at least one compression in the gaseous state, at least one preliminary cooling with at least partial condensation or liquefaction of said mixture at high pressure, at least one self-refrigeration with sub-cooling of at least one liquid fraction through heat exchange in counter-current relationship with the low pressure vapor originating from at least the same sub-cooled liquid fraction of said same refrigerating fluid, at least one expansion of at least said same fraction down to a low pressure with at least one conversion into said vapor which is then recompressed. In other words during these known operating steps, said mixture or fractions thereof are cooled in one or several heat exchangers in counter-current relationship with one or portions of itself expanded down to one pressure or pressures lower than said high pressure and then this mixture or said fractions thereof are expanded in one or several expansion members and are fed into the refrigerating heat exchanger or exchangers.

The process of saving energy and cost according to the invention is characterized in that it consists in reducing, for a same amount of treated products, the power absorbed by said compression by performing at least one or each aforesaid expansion dynamically in order to produce an outer mechanical work for instance likely to generate a continuous rotary motion.

When the fluid to be cooled is a gas to be liquefied flowing in particular in an open loop while being at least partially liquefied at high pressure and wherein at least its possibly or preferably previously sub-cooled liquid phase is expanded and then recovered or collected and for instance stored in a static condition at low pressure, it is advantageous that according to another characterizing feature of the invention, said expansion to also effected dynamically so as to provide a similar outer mechanical work.

According to still another characterizing feature of the invention, said outer mechanical work is recovered for generating either consumable converted energy or a useful technical effect.

According to still a further characterizing feature of the invention, at least one or each aforesaid expansion is carried out down to a pressure lower than at least 15 bars at said high pressure.

According to still another characterizing feature of the invention, each aforesaid dynamic, motive power generating expansion is followed by an additional passive expansion without any generation of outer work so as to keep the fluid involved in a monophasic liquid condition, thereby avoiding its vaporization at too low a pressure during said dynamic expansion.

According to a further characterizing feature of the invention, the nature or composition of at least one or each aforesaid refrigerating fluid is adapted to or matched with the number of dynamic expansions.

The invention aims also at providing an apparatus for carrying out said process, of the kind comprising: on the one hand an in particular open circuit for the fluid to be cooled, in particular for an aforesaid gas to be cooled, comprising at least the following elements: at least one passage-way for the fluid to be cooled within at least one heat exchanger through which said refrigerating fluid is flowing; at least one liquid-phase or liquefied-gas expansion member; as well as, on the other hand, a closed circuit for the refrigerating fluid, which is alone or is part of a system of several distinct circuits of respectively different refrigerating fluids, combined into a cold-generating cascade or the like, said or each circuit including at least the following elements: at least one compressor for gaseous refrigerating fluid, at least one cooler and/or condenser and at least said heat exchanger containing at least one flow passage-way for the at least partially liquefied refrigerating fluid and at least one passage-way for the vaporized refrigerating fluid extending in opposite direction relative to each aforesaid flow passage-way while being connected at its upstream end with the downstream end of said flow passage-way through the interposition of at least one member for expanding at least one fraction of the liquid phase of said refrigerating fluid and, at its downstream end, to the suction side of said compressor.

According to the invention, this apparatus is characterized in that at least one or each aforesaid expansion member consists of at least one driven cryogenic turbomachine having at least one hydraulic turbine or operating with a practically incompressible working fluid.

According to another characterizing feature of the invention, the fluid outlet of at least one or each aforesaid turbo-machine is connected to an additional expansion valve.

According to still a further characterizing feature of the invention, at least one or each aforesaid turbomachine has its shaft connected to at least one electric-power or work generating machine.

The invention thus defined brings about a substantial technical improvement because it offers the main following advantages:

a substantial reduction in the compression power required (i.e. the power absorbed by the compressors for the refrigerating fluids) for a same amount of liquefied fluid: this gain in power may reach for instance about 10% in the case of the liquefaction of the natural gas in particular rich in methane;

a possible energy recovery by using the mechanical energy provided by the cryogenic expansion hydraulic turbines for driving either electric-power generating machines or other auxiliary rotary machines; thus recovered energy may be for instance of up to about 5% of the energy consumed by said compressors.

It results therefrom that the invention makes it possible to achieve a total energy saving which may for instance be up to about 15% of the total energy input absorbed by the compressors for the refrigerating fluids.

The invention is applicable to any system of fluid refrigeration and its criterion of use is essentially conditioned by the energy-saving policy or economy of the country where it is worked because its interest mainly depends on the local energy cost and for instance in particular on the price of energy supply. Thus according to the relative value of such a cost, i.e. if the energy supply is relatively expensive, it may be advantageous to use cryogenic expansion hydraulic turbines even at less lower temperatures.

It should be pointed out in this connection that an expansion turbine is the more advantageous than an expansion valve as the temperature of the fluid to be expanded is lower before its expansion. The gain in refrigerating fluid compression power input, provided by the use of hydraulic expansion turbines, is the more better as the efficiency of the refrigeration cycle is worse. The refrigeration cycle should work with relatively high pressure differentials.

The heat exchangers and/or condensers used may be of any type such as in particular of the coiled type, of the plate type, of the finned-tube type and so on.

The invention will be better understood and further objects, characterizing features, details and advantages thereof will appear more clearly as the following explanatory description proceeds with reference to the accompanying diagrammatic drawings given by way of non-limiting examples only illustrating several presently preferred specific embodiments of the invention and wherein.

Figure 4:
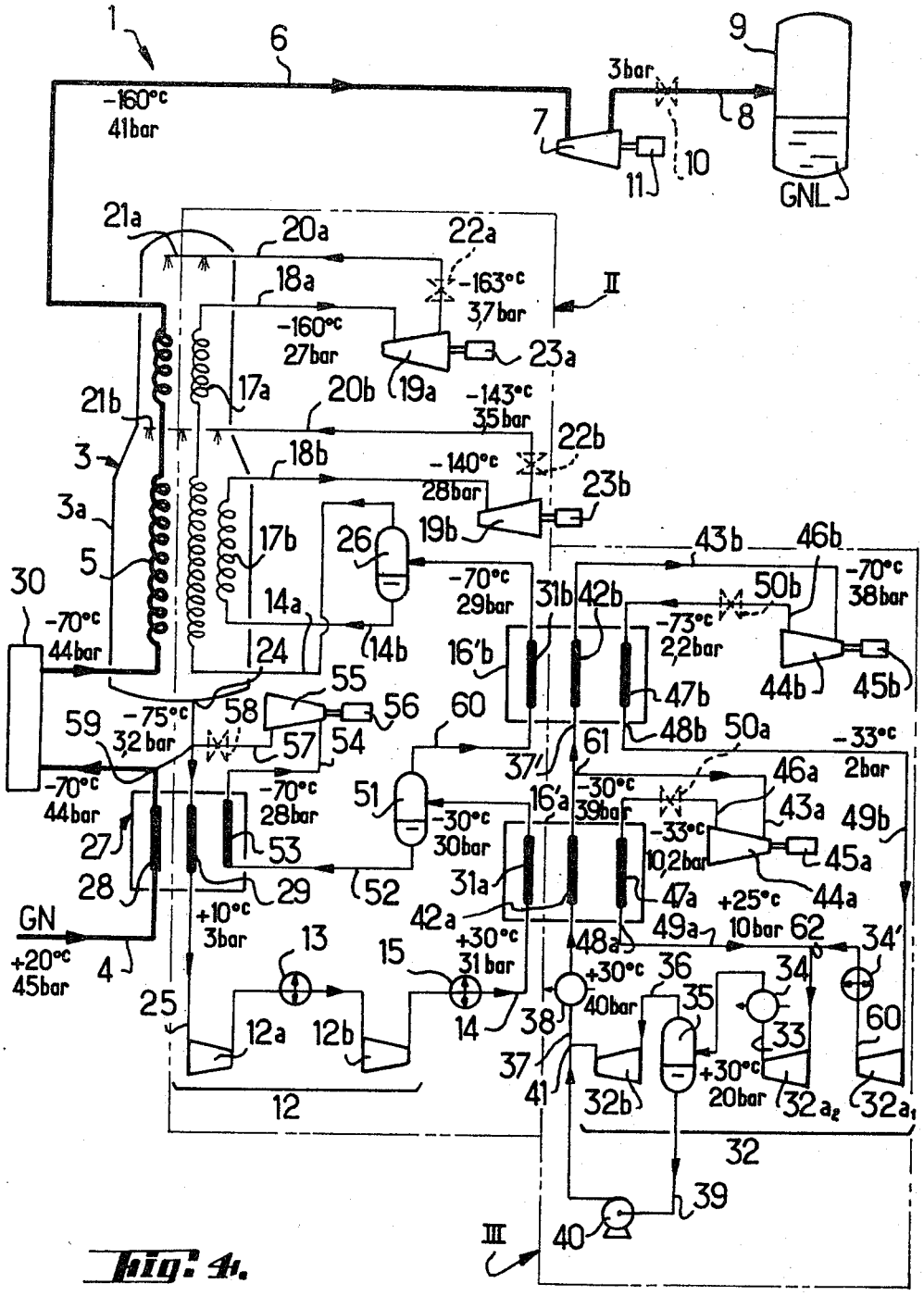
Figure 5:
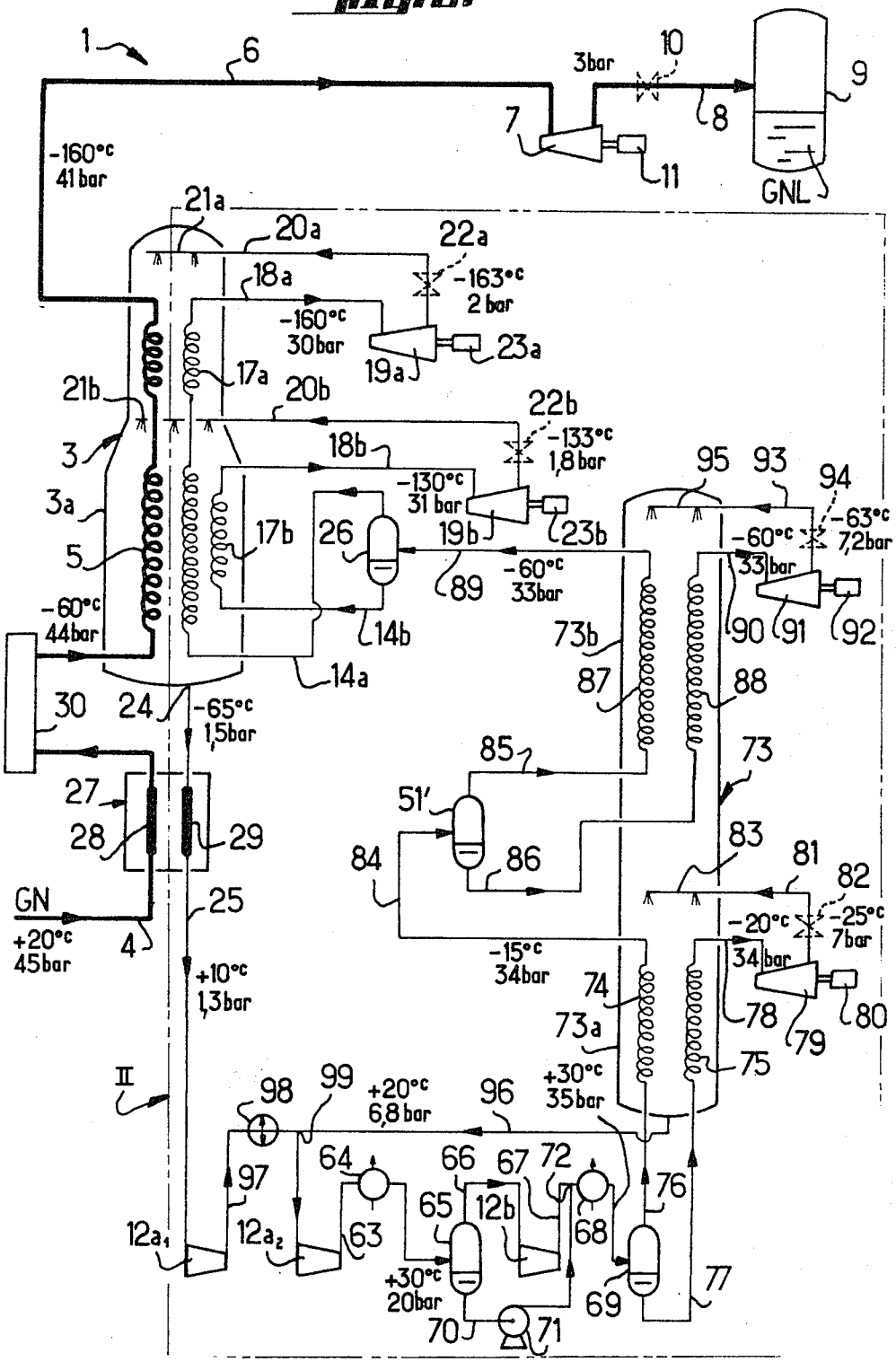

FIG. 4 shows still another embodiment with two refrigerating cycles for a main and an auxiliary fluid, respectively, with multiple-stage compression and double expansion of the auxiliary refrigerating fluid and with two heat exchangers connected in series for combining both cycles and three times expansion of the main refrigerating fluid; and FIG. 5 illustrates still another embodiment comprising a preliminary partial double liquefaction of the single refrigerating fluid within an auxiliary heat exchanging column.

In the various figures of the drawings, the same reference numerals are used to designate like or similar elements or parts and the numerical pressure values stated by way of example are absolute pressures.

Figure 1:
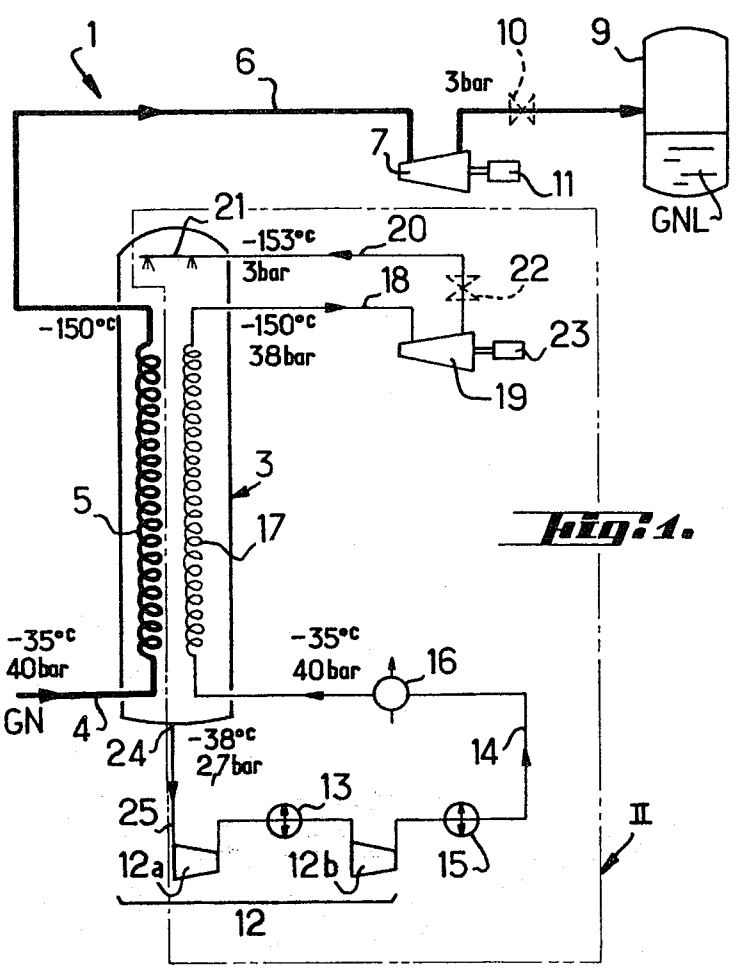
FIG. 1 shows a first embodiment of a system of liquefying a for instance natural gas by means of one single refrigerating fluid undergoing one single expansion.

According to the examplary embodiment shown on FIG. 1, the open circuit of cooled fluid in particular of for instance nature gas GN to be liquefied is generally designated by the reference numeral 1 whereas the closed circuit of main refrigerating fluid is generally denoted by the reference numeral 2, both circuits being thermally combined through the agency of at least one common cryogenic heat exchanger 3 for liquefying the gaseous fluid.

The open circuit 1 comprises an inlet duct 4 leading into the heat exchanger 3 and connected to at least one inner passage-way of this exchanger which consists for instance of a next, cluster or the like bundle of coiled tubes 5 the outlet of which is connected through a duct 6 to the inlet of a cryogenic hydraulic expansion turbine 7 the outlet of which communicates through a pipe-line 8 with a vessel or like tank 9 for preserving or storing for instance liquefied natural gas GNL. An expansion valve 10 may advantageously but optionally be inserted into the pipe-line 8 between the turbine 7 and the tank 9. The powered output drive shaft of the turbine 7 may advantageously but optionally be coupled to a rotary machine 11 to be driven which is for instance an electric power generator (thus forming an electric power generating set with the turbine 7).

The closed circuit 2 (bounded and symbolically shown by a box or rectangle drawn in chain-dotted discontinuous lines) contains a refrigerating fluid consisting of a mixture of several components at least a major part of which consists advantageously of hydrocarbons.

This circuit 2 successively comprises in the direction of flow of the refrigerating fluid: at least one compressor 12 for the refrigerating fluid in the gaseous state, having for instance two stages, namely a low pressure stage **12*a* and a high pressure stage 12*b* driven each one either separately by an individual prime mover or together jointly by a common motor while having then their respective shafts coupled mechanically. This compressor is adapted to compress the refrigerating fluid in the gaseous state and the compressed fluid outlet or delivery port of the low pressure stage 12***a* is connected to the suction port of the high pressure stage 12*b* through an intermediate or inter-stage cooler 13 the cooling fluid of which is advantageously supplied from the outside and consists for instance of water or air. The outlet or delivery port of the high pressure compression stage 12*b* is connected to a corresponding inlet of the heat exchanger 3 through at least one final or after-cooler 15 and at least one condenser 16. The after-cooler 15 is advantageously of the same kind as the inter-stage cooler 13, i.e. with a cooling fluid supplied from the outside and consisting for instance of water or air whereas the condenser 16 has its cooling fluid also supplied from the outside and consisting for instance of propane or propylene. More specifically at the inlet into the heat exchanger 3, the piper-line 14 is connected to the upstream end of at least one inner flow passageway 17 extending generally in the same direction as the flow passage-way 5 and having its downstream end connected through a duct 18 issuing from the heat exchanger 3 to the inlet of a cryogenic hydraulic turbine or the like 19 located for instance outside of the heat exchanger 3. The outlet of this turbine 19 is connected through a duct 20 to a distributing system placed inside of the heat exchanger 3 and consisting either of at least one confined passage-way extending in at least approximately parallel relation to the flow passage-ways 5 and 17, from the respective downstream ends to the respective upstream ends thereof, or of a jet-producing spray device or the like 21 communicating with the inner space of the casing or shell of the heat exchanger 3 and opening directly into that space, so that the sprayed fluid would flow while keeping vaporizing in said direction about the flow passage-ways 5 and 17 so as to stream thereabout in direct contact therewith.

At least one additional expansion valve 22 may be inserted into the pipe-line 20 between the outlet of the turbine 19 and the corresponding inlet of the heat exchanger 3. The output drive shaft of the turbine 19 may possibly be coupled mechanically with the drive shaft of a rotary machine 23 for instance of the same kind as the rotary machine 11 and consisting in particular either of an electric power generator or of any work-producing machine.

The operation of this system is then the following: the for instance natural gas GN to be liquefied is fed into the duct 4 at an absolute high pressure for instance of about 40 bars and at a temperature for instance of about −35° C. This gas flows through the flow passage-way 5 of the heat exchanger 3 while being therein in heat exchange with said refrigerating fluid so as to be successively cooled down until liquefaction and then sub-cooled, so as to leave the heat exchanger 3 still at a high pressure through the duct 6 while being at a temperature for instance of about −150° C. The liquefied gas then flows through the hydraulic turbine 7 and expands therein down to a low pressure for instance of about 3 bars while therein producing an outer work driving the turbine 7 in a continuous rotary motion, which turbine may in turn possibly drive a rotary machine 11 mechanically to provide a useful technical effect. When issuing from the turbine 7, this expanded fluid possibly undergoes an additional expansion through an expansion valve 10 so as to be for instance eventually recovered or collected and stored in the liquid condition GNL in the tank 9.

As to the operating cycle of the refrigerating fluid, the latter is drawn in the wholly vaporized state at a low pressure for instance of 2.7 bars in a temperature for instance of about −38° C. into the low pressure compression stage 12*a* of the compressor 12 wherefrom it is discharged at an intermediate pressure through the inter-stage cooler 13 and then drawn into the high pressure compression stage 12*b* of the same compressor which then delivers it still in the gaseous state at a high pressure for instance of about 40 bars into the pipe-line 14 successively through the after-cooler 15 and then through the condenser 16 where the refrigerating fluid is condensed partially or wholly still at the same aforesaid high pressure and at a temperature for instance of about −35° C. It then enters the flow passage-way 17 of the heat exchanger 3 where it is in heat exchange with a vaporized portion of itself, so as to be further cooled therein possibly until total liquefaction (if same has not fully taken place within the condenser 16) and then to be sub-cooled therein in the liquid condition down to a temperature for instance of about −150° C. at a pressure of about 38 bars for being then fed through the pipe-line 18 into the hydraulic turbine 19 where it expands down to a low pressure for instance of about 3 bars at a temperature for instance of about −150° C. and then returns through the pipe-line 20 into the heat exchanger 3, possibly after having flown through the valve 22 to undergo an additional expansion therein. The expansion within the turbine 19 would generate or sustain the continuous rotary motion thereof with possible attendant driving of the rotary machine 23. The expanded refrigerating fluid is then distributed through the for instance jet-producing spray member 21 inside of the casing or shell of the exchanger 3 and this refrigerating fluid is flowing while keeping vaporizing within that shell through the heat exchanger in counter-current relationship with respect to the flow passage-ways 5 and 17 which it strongly cools while streaming thereabout (thereby inducing, within these flow passage-ways,the total liquefaction of the fluids contained therein and then the respective sub-cooling thereof). The vaporized refrigerating fluid issues from the heat exchanger 3 through the outlet port 24 at said low pressure of 2.7 bars and at the temperature of −38° C. to flow back through the duct 25 to the suction port of the low pressure stage 12*a* of the compressor 12, so as to resume the cycle which is thus repeated as long as the circuit 1 is fed with a flow rate of gas to be liquefied. Since owing to the invention the expansion of the liquefied gas within the turbine 7 enables the gas to be cooled down substantially more than through a simple valve, this makes it possible to reduce the cooling capacity or power of the heat exchanger 3 hence also the required input power absorbed by the compressor 12, thus making the plant less expensive. Due to the replacement according to the invention of the usual expansion valves by hydraulic expansion turbines, the heavy energy loss within such valves in view of the great pressure differential in the expansion is thus removed so that the system according to FIG. 1 which is very advantageous on account of its simplicity becomes of particular interest owing to its high performance.

Figure 2:
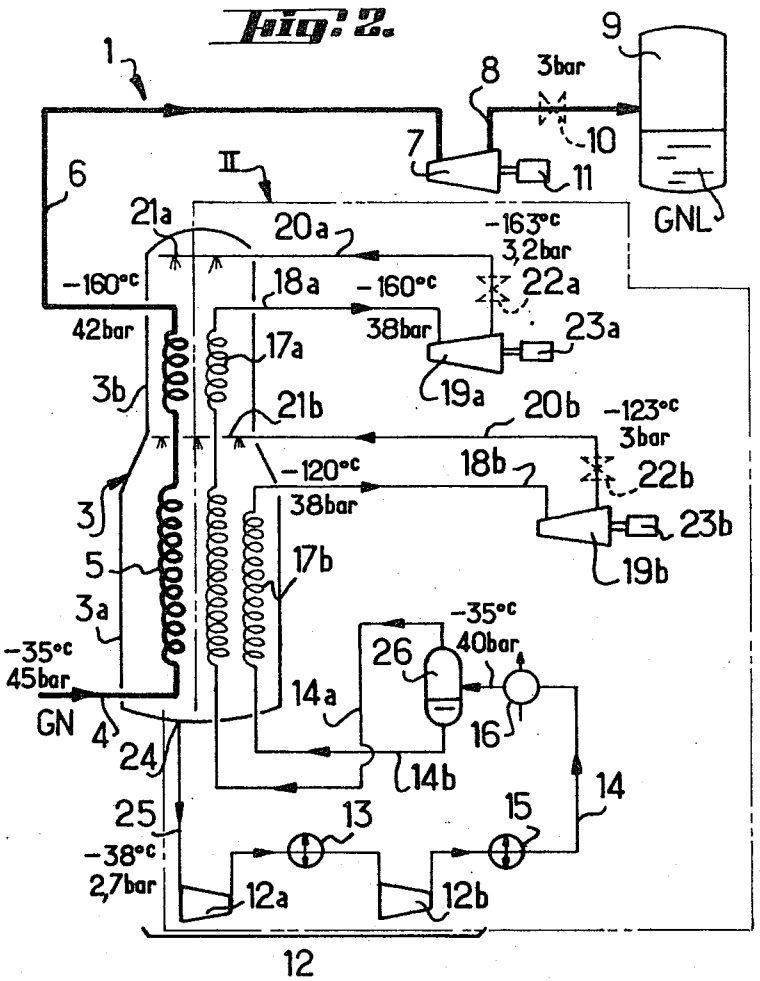
FIG. 2 illustrates an alternative embodiment or modification of the foregoing system, with phase separation and double expansion of the refrigerating fluid.

The system shown on FIG. 2 differs from the one illustrated in FIG. 1 by the more elaborated construction of the circuit and operating cycle 2 of the refrigerating fluid. The heat exchanger 3 is split here into two parts or sections 3*a* and 3*b* which instead of being part of a same apparatus or common assembly may consist of separate units communicating with or connected in series to each other. In the section 3*a* is carried out the liquefaction of the fluids involved and in particular of the gas to be liquefied as well as of the gaseous phase of the refrigerating fluid whereas in the section 3b is effected the sub-cooling of the fluids respectively liquefied in the section 3a.

Between the condenser 16 and the section 3a of the heat exchanger 3 is inserted a phase separator 26 connected to the outlet of the condenser 16 whereas the flow passage-way of FIG. 1 is here substituted for by two flow passage-ways 17a and 17b, respectively, extending in substantially parallel relationship and the first one of which extends successively within the sections 3a and 3b of the heat exchanger 3 whereas the other one 17b extends within the section 3a only. The flow passage-way 17a has its upstream end connected through the pipe-line 14a to the vapor phase collecting space of the phase separator 26 whereas the flow passage-way 17b has its upstream end connected through the pipe-line 14b to the liquid phase collecting space of the phase separator 26. The downstream end of the flow passage-way 17a is connected through a pipe-line 18a to the inlet of the cryogenic hydraulic expansion turbine 19a (possibly coupled with its shaft mechanically to a rotary machine 23a) the outlet of which is connected through the pipe-line 20a (possibly through an additional expansion valve 22a) to an (in particular jet-producing spray) distribution member 21a positioned at the corresponding end of the section 3b of the heat exchanger 3. The downstream end of the flow passage-way 17b is connected through the pipe-line 18b to the cryogenic hydraulic expansion turbine 19b (possibly coupled with its shaft mechanically to a rotary machine 23b) the outlet of which is connected through the pipe-line 20b (possibly through an additional expansion valve 22b) to the (for instance jet-producing spray) distribution member 21b placed at an intermediate position within the heat exchanger 3 substantially at that end which is common to both adjacent sections 3a and 3b thereof.

This system operates as follows:

The natural gas GN for instance at a temperature of about −35° C. and at a pressure for instance of about 45 bars enters in the gaseous state the segment of the flow passageway 5 located within the section 3a of the heat exchanger 3 and is liquefied therein and afterwards this liquefied gas is sub-cooled in that portion of the flow passage-way 5 which is located within the section 3b of the heat exchanger 3 wherefrom it issues at a temperature for instance of −160° C. and at an absolute pressure of 42 bars for being then successively expanded and stored as described with reference to FIG. 1.

The refrigerating fluid, compressed at a high pressure, is partially condensed in the condenser 16 for instance at the temperature of −35° C. and at a pressure of 40 bars into a mixture of gaseous and liquid phases, respectively, which are separated from each other in the separator 26. The gaseous phase is fed by the duct 14a into the segment of the flow passage-way 17a located in the section 3a of the heat exchanger 3 to be liquefied therein and then this liquefied fraction is sub-cooled in that portion of the flow passageway 17a which is placed in the section 3b of the heat exchanger 3, wherefrom this sub-cooled fraction issues through the pipe-line 18a at a temperature for instance of about −160° C. and at a pressure for instance of about 38 bars to thereafter flow through the hydraulic turbine 19a while expanding therein. This expansion (which induces a continuous rotary motion of the turbine and possibly of the rotary machine 23a) has cooled that fraction down to a temperature for instance of about −163° C. thereby lowering its pressure for instance down to about 3.2 bars and this expanded fraction is fed by the pipe-line 20a (possibly after an additional expansion in the valve 22a) to the distributing member 21a wherein the expanded fraction is sprayed for instance. The refrigerating fluid thus sprayed flows for instance inside of the casing or shell of the heat exchanger 3 while keeping vaporizing and streaming about the flow passage-ways 5, 17a and 17b in counter-current relation to the fluids carried in these flow passage-ways, respectively. The fraction of liquid refrigerating fluid, coming from the separator 26, is fed through the duct 14b, into the flow passageway 17b of the heat exchanger 3 to be sub-cooled therein down to a temperature for instance of about −120° C. at a pressure for instance of about 38 bars and it leaves the heat exchanger 3 through the duct 18b to thereafter flow through the hydraulic turbine 19b while expanding therein (thus inducing the continuous rotary motion of the turbine and possibly of the driven rotary machine 23b). This expansion has thus cooled this fraction down to a temperature for instance of about −123° C. thereby lowering its pressure for instance down to about 3.0 bars and the expanded fluid is fed through the duct 20b to the distributing member 21b for being for instance sprayed therein inside of the shell of the section 3a of the heat exchanger 3 wherein it keeps vaporizing. This vaporized fraction of the refrigerating fluid mixes with the vaporized fraction of the refrigerating fluid coming from the section 3b of the heat exchanger to flow for instance while streaming about the three flow passage-ways 5, 17a and 17b in counter-current direction with respect to the directions of flow of the respective fluids in these three flow passage-ways. Such a direct contact between the vaporized refrigerating fluid and said flow passage-ways will result in a strong heat exchange therebetween, thus achieving on the one hand the strong sub-cooling of the liquefied gas and of the liquefied refrigerating fluid flowing in the corresponding portions of the flow passage-ways 5 and 17a, respectively, located in the section 3b of the heat exchanger 3 and on the other hand the liquefaction of these fluids in the corresponding portions of the flow passage-ways 5 and 17a positioned in the section 3a of the heat exchanger as well as the sub-cooling of the liquid refrigerating fluid circulating in the flow passage-way 17b in the same section 3a of the exchanger. The total vaporized refrigerating fluid issuing from the heat exchanger 3 through the outlet port 24 and the duct 25 at the temperature of −38° C. and at the pressure of 2.7 bars is drawn in again by the compressor 12 with a view to repeating the refrigerating cycle.

Figure 3:
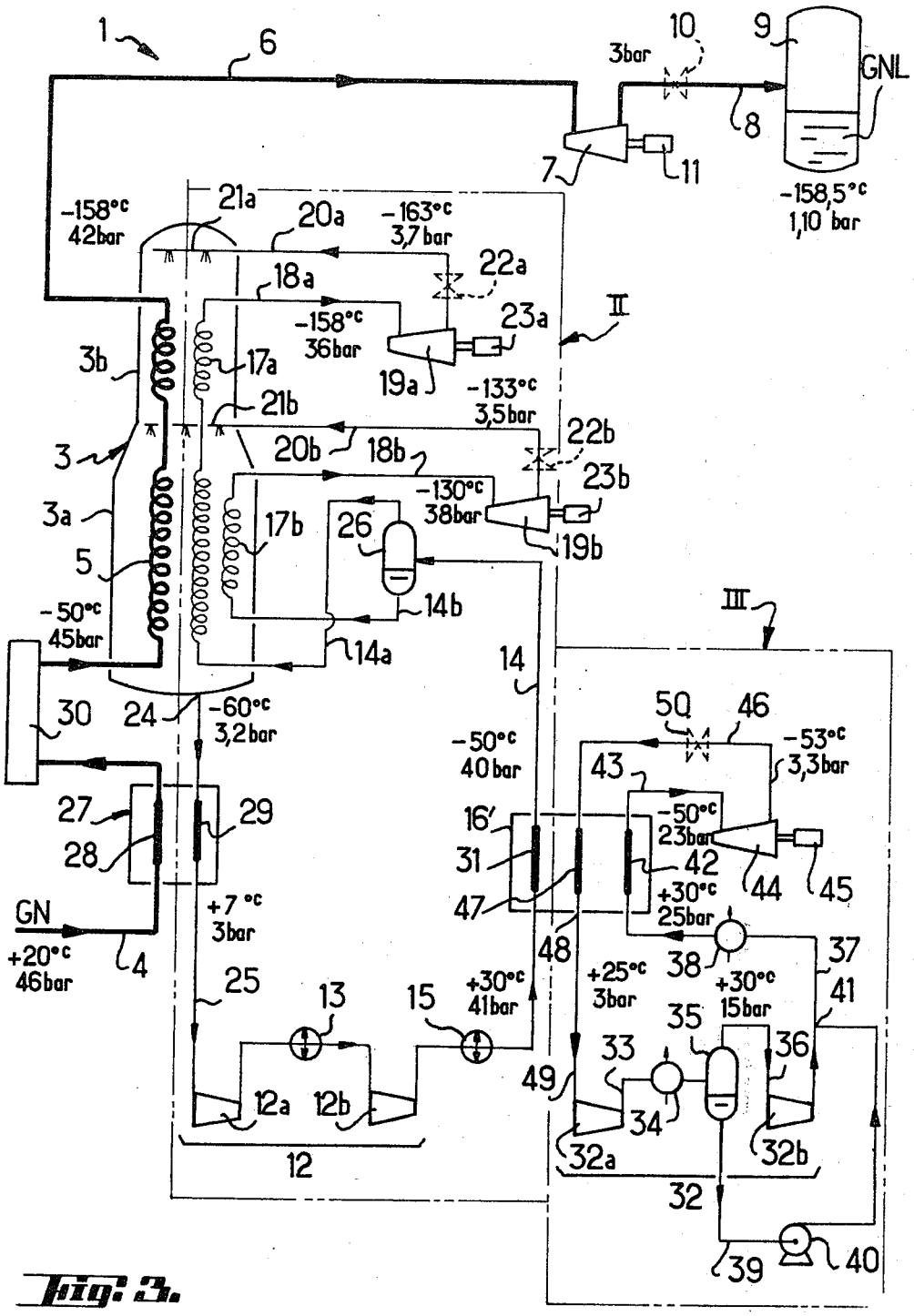
FIG. 3 shows another embodiment with the use of two refrigerating cycles for a main and an auxiliary fluid, respectively, combined into a cold-generating cascade by a common heat exchanger, with a single expansion of the auxiliary refrigerating fluid and precooling of the gas to be liquefied.

The system shown in FIG. 3 differs mainly from that shown in FIG. 2 on the one hand by a previous cooling of the gas to be liquefied and on the other hand by the use of two distinct cycles of refrigerating fluids, namely a cycle of main or light refrigerating fluid 2 and a cycle of auxiliary or heavy refrigerating fluid 3, consisting of a mixture of components and combined into a kind of cold-generating incorporated cascade by means of a condenser 16' forming a cryogenic heat exchanger common to both refrigeration cycles 2 and 3 between which it thus provides a thermal connection.

The circuit 1 of gas to be liquefied thus comprises a cryogenic heat exchanger 27 for previous refrigeration of the gas to be processed and common to both circuits of gas to be liquefied 1 and of main or light refrigerating fluid 2. This exchanger 27 is for instance of the plate type and includes passage-ways 28, 29 inserted respectively in the duct 4 before the heat exchanger 3 and in the duct 25 between the outlet 24 of the heat exchanger 3 and the low pressure suction port of compressor 12. In the duct 4 between the outlet of the exchanger 27 and the inlet of the exchanger 3 may also be inserted a gas treating apparatus 30 (effecting for instance the removal of heavy components therefrom).

The circuit 1 then operates as follows:

the gas to be liquefied GN, entering the duct 4 at a temperature for instance of about +20° C. and at an absolute pressure for instance of about 46 bars flows through the passage-way 28 of the heat exchanger 27 to be preliminarily cooled and possibly partially condensed therein through heat exchange with the main refrigerating fluid circulating in the passage-way 29. When leaving the exchanger 27, the gas flows through the treating apparatus 30 wherefrom it issues at a temperature for instance of about −50° C. and at a pressure for instance of about 45 bars to thereafter flow through the flow passage-way 5 of the heat exchanger 3 to be fully liquefied and then sub-cooled therein down to a temperature for instance of about −158° C. and at a pressure for instance of about 42 bars. This liquefied gas is thereafter expanded and then stored as previously described for instance at −158.5° C. and 1.10 bar.

In the cycle 2 of the main or light refrigerating fluid, the condenser 16' forming a cryogenic heat exchanger advantageously of the plate type comprises at least one flow passage-way 31 inserted in the duct 14 between the outlet of the after cooler 15 and the inlet of phase separator 26. This cycle 2 then operates as follows:

When issuing from the after-cooler 15, the main refrigerating fluid is for instance at a temperature of about +30° C. and at a pressure of about 41 bars and flows through the flow passage-way 31 of the cryogenic exchanger 16' to be partially condensed therein through heat exchange with the auxiliary or heavy refrigerating fluid from the refrigeration cycle 3. The main or light refrigerating fluid thus partially condensed for instance at a temperature of about −50° C. and at a pressure of about 40 bars will then undergo a phase separation within the separator 26. Its liquid phase sub-cooled within the heat exchanger 3 for instance down to a temperature of about −130° C. and at a pressure for instance of about 38 bars is expanded as mentioned hereinbefore thereby having its temperature lowered for instance to about −133° C. and its pressure lowered to 3.5 bars and then keeps vaporizing in the heat exchanger 3 whereas the vapor phase of the main refrigerating fluid, successively liquefied and then sub-cooled in the heat exchanger 3 for instance down to a temperature of about −158° C. and at a pressure of about 36 bars is expanded as aforesaid thus having its temperature lowered for instance to about −163° C. and its pressure lowered for instance to about 3.7 bars and it keeps vaporizing in the heat exchanger 3. The total vaporized main refrigerating fluid issuing from the heat exchanger 3 through the outlet port 24 for instance at a temperature of about −60° C. and at a pressure of about 3.2 bars flows through the passage-way 29 in counter-current relation to the direction of flow of the gas to be liquefied in the passage-way 28 for cooling the latter therein through heat exchange. The main refrigerating fluid thus reheated in the heat exchanger 27 leaves the latter for instance at a temperature of about +7° C. at a low pressure of about 3 bars to be drawn in again through the pipe-line 25 by the compressor 12.

The closed circuit 3 of auxiliary or heavy refrigerating fluid successively comprises in the direction of flow of the latter: a compressor set 32 consisting of two stages or compressors, namely a low pressure stage or compressor **32*a* and a high pressure stage or compressor 32*b*. The intermediate pressure outlet or delivery port of the first compressor 32*a* is connected to a duct 33 connected to the inlet of a condenser 34 which advantageously is of the type operating with an outer coolant consisting for instance of water or air. The outlet of the condenser 34 is connected to a phase separator 35 the gaseous phase collecting space of which is connected through a pipe-line 36 to the suction port of the second compressor 32*b* the outlet or discharge port of which is connected through a pipe-line 37 to a condenser 38 which is advantageously of the type operating with an outer cooling medium consisting for instance of water or air. The liquid phase collecting space of the phase separator 35 is connected by a duct 39 through a circulating and accelerating pump 40 to the delivery duct 37 of the second compressor 32*b* at a branch point 41 located between the latter and the condenser 38**.

The auxiliary refrigerating fluid outlet of the condenser 38 is connected to the upstream end of at least one flow passage-way 42 contained in the heat exchanger 16' and the outlet of which is connected through a pipe-line 43 to the inlet of a cryogenic hydraulic expansion turbine 44 which is outside of the heat exchanger 16'. The shaft of this hydraulic turbine 44 is possibly coupled mechanically to a rotary machine 45. The outlet of the hydraulic turbine 44 is connected through a pipe-line 46 to the upstream end of at least one passage-way 47 for the auxiliary refrigerating fluid inside of the heat exchanger 16', which is for instance of the plate construction type. The flow lines and passage-ways 31, 42 and 47 extend in generally parallel relation to a same direction while being in mutual heat exchange with each other. The downstream end of the passage-way 47 is connected through the outlet 48 of the heat exchanger 16' by a pipe-line 49 to the suction port of the first compressor **32*a***.

The operation of this cycle 3 of auxiliary or heavy refrigerating fluid is then the following: the auxiliary refrigerating fluid is sucked in the gaseous state for instance at a temperature of about +25° C. and at a low pressure of about 3 bars by the first compressor **32*a* which discharges it at an intermediate pressure through the condenser 34 where the compressed auxiliary refrigerating fluid partially condenses into a mixture of gaseous and liquid phases, respectively, which are thereafter separated within the phase separator 35. The gaseous phase, which is for instance at a temperature of about +30° C. and at an intermediate pressure of about 15 bars, is drawn in by the second compressor 32*b* to be delivered at high pressure into the duct 37. The liquid phase at said same intermediate pressure is drawn in by the pump 40 which raises its pressure up to the delivery pressure of the second compressor 32*b* and forwards this compressed liquid phase until it joins at 41 the gaseous refrigerating fluid discharged at high pressure into the pipe-line 37. This mixture of high pressure gaseous and liquid phases, respectively, then flows through the condenser 38 where the auxiliary refrigerating fluid is fully condensed and leaves this condenser for instance at a temperature of about +30° C. and at a pressure of about 25 bars. The liquid refrigerating fluid then flows through the flow passage-way 42 of the heat exchanger 16' where it is sub-cooled for instance down to a temperature of about −50° C. and at a pressure of about 23 bars through heat exchange with a vaporized fraction of itself. This refrigerating fluid thus sub-cooled then flows through the hydraulic turbine 44 to be expanded therein (thus inducing a continuous rotary motion of this turbine and possibly the attendant drive of the rotary machine 45), thereby having its temperature lowered for instance to about −53° C. and its pressure lowered to about 3.3 bars. When issuing from the turbine 44, the expanded refrigerating fluid may optionally be expanded additionally by flowing through an expansion valve 50 possibly inserted in the duct 46 and thereafter flows through the passage-way 47 to keep vaporizing at low pressure by circulating therein in counter-current relation to the respective directions of flow of the fluids in the flow passage-ways 31 and 42. The vaporized auxiliary refrigerating fluid thus provides through heat exchange on the one hand for the cooling of the main or light refrigerating fluid in the flow passage-way 31 until its partial condensing and on the other hand for the sub-cooling of the heavy or auxiliary liquid refrigerating fluid circulating in the flow passage-way 42. At its egress 48 from the heat exchanger 16', the vaporized auxiliary refrigerating fluid is for instance at a temperature of about +25° C. and at a pressure of about 3 bars at which it is drawn in again in the gaseous state by the first compressor 32*a* for causing the refrigerating cycle 3** to be repeated.

By way of mere illustration, a comparison of the respective performances of a system according to the invention as shown on FIG. 3 and of a system according to the prior art using a circuit diagram similar to that shown on FIG. 3 but wherein the expansions are made in valves, is given hereinafter.

In both cases considered (invention and prior art), the natural gas to be liquefied is available in the following conditions:

temperature: 20° C.
absolute pressure: 45 bars
mass flow rate: 181,500 kg/h
chemical composition in % in weight:
methane: 79.56
ethane: 9.95
propane: 7.29
isobutane: 1.60
normal butane: 1.60

At the outlet of the expansion member the liquefied gas is obtained in the following conditions:

temperature: −158.5° C.
absolute pressure: 3 bars
mass flow rate: 181,500 kg/h
chemical composition: identical with that of natural gas.

The liquid natural gas is then stored in a tank at an absolute pressure of about 1.10 bar.

The active surfaces of the heat exchangers 16', 27, **3*a* and 3*b*** are identical and the values of the ratios of the amounts of heat exchanged at the main or average temperature approaches are the following, respectively:

8,500,000 kcal/h/°C. for the heat exchanger 16';
1,450,000 kcal/h/°C. for the heat exchanger 27;
9,200,000 kcal/h/°C. for the heat exchanger **3*a***;
1,700,000 kcal/h/°C. for the heat exchanger **3*b***.

The comparison of the respective performances of both aforesaid cases is given by the numerical data of the following table:

TABLE 1

| Performances | Invention according to FIG. 3 | Prior art according to FIG. 3 without turbines (expansion in valves) |
|---|---|---|
| Main cycle 2 | | |
| Characteristics of refrigerating fluid: | | |
| Total mass flow rate in kg/h: | 339,320 | 352,850 |
| Composition in % by weight: | | |
| - nitrogen | 7.24 | 8.37 |
| - methane | 26.91 | 26.51 |
| - ethane | 49.79 | 51.84 |
| - propane | 16.06 | 13.27 |
| Power of compressors 12 in kW: | 33,737 | 35,283 |
| Auxiliary cycle 3 | | |
| Total mass flow rate in kg/h: | 416,013 | 431,270 |
| Composition in % by weight: | | |
| - methane | 0.78 | 1.18 |
| - ethane | 32.66 | 33.11 |
| - propane | 24.48 | 25.89 |
| - isobutane | 21.04 | 19.91 |
| - normal butane | 21.04 | 19.91 |
| Powers of compressors 32 in kW: | 16,961 | 18,463 |
| Power of turbines in kW: | | |
| - turbine 7 | 350 | 0 |
| - turbine 19a | 92 | 0 |
| - turbine 19b | 325 | 0 |
| - turbine 44 | 290 | 0 |
| Total power of turbines in kW: | 1,057 | 0 |
| Total power of compressors in kW | 50,698 | 53,746 |

It is thus found that the gain in total power of the compressors is of 3,048 kW or about 6% of the total power of the compressors. The total power which may possibly be recovered as mechanical energy on the shafts of the expansion turbines is 1,057 kW or about 2% of the total compression power.

The expansion of the liquefied natural gas GNL is carried out in the turbine 7 only. The respective expansions of the main and auxiliary refrigerating fluids are carried out in two steps, namely:

a monophasic expansion in each expansion turbine **19*a*, 19*b*, 44**;
a diphasic expansion in each valve **22*a*, 22*b*, 50** located downstream.

The next absolute pressure reductions are obtained through the expansions carried out according to the circuit diagram of FIG. 3:

liquefied natural gas GNL expanded from 42 bars to 3 bars in the turbine 7;
main refrigerating fluid expanded from 36 bars to 6.2 bars in the turbine **19*a***;
main refrigerating fluid expanded from 6.2 bars to 3.7 bars in the valve **22*a***;
main refrigerating fluid expanded from 38 bars to 7 bars in the turbine **19*b***;
main refrigerating fluid expanded from 7 bars to 3.5 bars in the valve **22*b***;
auxiliary refrigerating fluid expanded from 23 bars to 4.3 bars in the turbine 44;
auxiliary refrigerating fluid expanded from 4.3 bars to 3.3 bars in the valve 50.

In both cases considered of the invention and of the prior art, respectively, the operating conditions are the same except for the following:

TABLE 2

| Conditions | Invention | Prior art |
|---|---|---|
| Temperature of the liquefied natural gas at 6 and of the main refrigera- | | |

TABLE 2-continued

| Conditions | Invention | Prior art |
|---|---|---|
| ting fluid at 18a, in °C. | −158 | −160 |
| Absolute pressure of the auxiliary refrigerating fluid at the outlet of 38, in bars | 25 | 26.4 |
| Absolute pressure of the auxiliary refrigerating fluid at 43, in bars | 23 | 24.4 |

The gains in power achieved due to the use of the turbines are stated in the numerical data of the following table:

TABLE 3

| Turbine n° | Turbine power in kW | Expansion temperature, in °C. | Gain in refrigerating fluid compression power, in kW |
|---|---|---|---|
| 7 | 350 | −158 | 1,403 |
| 19a | 92 | −158 | 380 |
| 19b | 325 | −130 | 982 |
| 44 | 290 | −50 | 283 |
| Total sum | 1,057 | | 3,048 |

It is seen that the use of a hydraulic expansion turbine is the more advantageous as the temperature is lower.

In the typical examplary embodiment according to FIG. 3, the required total power of the compressors 12 and 32 for the main or light and auxiliary or heavy refrigerating fluids, respectively, thus has the following values:

without using the turbines 7, 19*a*, 19*b* and 44: 53,746 kW;

when using said turbines: 50,698 kW.

Therefore the use of said hydraulic expansion turbines makes it possible to achieve a total gain of 3,048 kW in the power of the compressors for the refrigerating fluids in the typical example considered whereas the total mechanical effective power which may be recovered on the turbine shafts whould amount to 1,057 kW.

The system according to FIG. 4 relates to a more elaborated structure of both cycles of the main or light refrigerating fluid 2 and the auxiliary or heavy refrigerating fluid 3, respectively. The condensing heat exchanger 16' of FIG. 3 has been replaced here by two distinct units 16'*a* and 16'*b* forming heat exchangers for instance of the plate construction type, respectively, and communicating with or connected in series to each other, which may be either distinct units or units integrated into a same common heat exchanger body of which they form two successive parts.

In the cycle 2 of the main or light refrigerating fluid the outlet of the after-cooler 15 is connected through a duct 14 to the upstream end of at least one flow passage-way 31*a* contained in a first condensing heat exchanger 16'*a* and the downstream end of this flow passage-way 31*a* is connected at the outlet of this exchanger 16'*a* to a phase separator 51. The liquid phase collecting space of this separator is connected through a pipe-line 52 to the upstream end of at least one flow passage-way 53 contained in the heat exchanger 27 and extending therein in substantial parallel relation to the general common direction of the passage-ways 28 and 29. The downstream end of the flow passage-way 53 is connected through a pipe-line 54 to the inlet of a hydraulic expansion turbine 55 (the shaft of which is possibly coupled mechanically to a rotary machine 56) the outlet of which is connected by a pipe-line 57, possibly through an additional expansion valve 58 to the duct 25 at a branch point 59 located between the outlet port 24 of the heat exchanger 3 and the corresponding inlet port of the heat exchanger 27.

The gaseous phase collecting space of the phase separator 51 is connected through a pipe-line 60 to the upstream end of at least one flow passage-way 31*b* extending in the second condensing heat exchanger 16'*b* and the upstream end of which is connected through an outer duct to the phase separator 26 already described with reference to FIG. 3.

In the closed circuit 3 of the auxiliary or heavy refrigerating fluid, the compressor set 32 here consists successively, in the direction of flow of the refrigerating fluid, of a first compressor $32a_1$, of a second compressor $32a_2$ and of a third compressor 32*b* forming a like number of compression stages and which may be operatively driven as in the embodiments of the foregoing figures either separately by individual prime movers, respectively, or at least two or all of them may be driven by one single common prime mover while being thus mechanically coupled to one another through their respective shafts. Moreover as in the embodiments previously described and shown the compressor sets 12 and 32 for the main and auxiliary refrigerating fluids, respectively, may be driven either separately by individual prime movers or both sets or at least two compressors belonging to each set, respectively, may be driven by a common prime mover while being thus mechanically coupled to each other.

The outlet or delivery port of the first compressor $32a_1$ is connected by means of a duct 60 to the suction port of the second compressor $32a_2$ through an intermediate or inter-stage cooler 34' which is advantageously of the type having an outer cooling fluid consisting for instance of water or air. The second compressor $32a_2$ and the third compressor 32*b* here are comparable to the first and second compressors 32*a* and 32*b*, respectively, of the circuit diagram according to FIG. 3, so that their mutual connecting configuration is similar to that shown on FIG. 3.

The outlet of the after-cooler 38 is connected to the upstream end of at least one flow passage-way 42*a* contained in the first condensing heat exchanger 16'*a* and the downstream end of which is connected through an intermediate duct 37' to the upstream end of at least one flow passage-way 42*b* located in the second condensing heat exchanger 16'*b* and the downstream end of which is connected through an outer duct 43*b* to the inlet of a hydraulic expansion turbine 44*b* (the shaft of which is possibly coupled mechanically to a rotary machine 45*b*). The outlet of the turbine 44*b* is connected by means of a duct 46*b* (and possibly through an additional expansion valve 50*b*) to the upstream end of at least one passage-way 47*b* contained in the second condensing heat exchanger 16'*b* and the downstream end of which is connected through an outer duct 49*b* to the suction port of the first compressor $32a_1$. As a matter of fact, the intermediate duct 37' is bifurcated because at an intermediate branch point 61 thereof is connected a branch duct 43*a* connecting this point to the inlet of a cryogenic hydraulic expansion turbine 44*a* (the shaft of which is possibly coupled mechanically to a rotary machine 45*a*). The outlet of this turbine 44*a* is connected by a pipe-line 46*a* possibly through an additional expansion valve 50*a* to the upstream end of at least one passage-way 47*a* extending in the first condensing heat exchangers 16'*a* and the downstream end of which is connected at the outlet 48*a* of said exchanger through an outer duct 49*a* to the suction port of the second compressor 32*a*$_2$ while joining the duct 60 at a common branch point 62.

The outstanding features of the operation of this system according to FIG. 4 are then the following:

In the circuit 1, the gas to be liquefied GN, fed through the duct 4 for instance at a temperature of about +20° C. and at a pressure of about 45 bars flows through the passage-way 28 of the cooling device 27 to be preliminarily cooled therein through heat exchanger with the main or light refrigerating fluid for instance down to a temperature of about =70° C. and at a pressure of about 44 bars. The gas thus cooled then flows possibly through a gas processing apparatus 30 which for instance will remove its heaviest components therefrom before flowing through the heat exchanger 3 to be successively liquefied and then sub-cooled therein for instance down to a temperature of about −160° C. at a pressure of about 41 bars. When leaving this heat exchanger the sub-cooled liquefied gas is successively expanded and then stored as previously described.

In the closed circuit of the main or light refrigerating fluid 2, the latter, issuing in the gaseous state from the after-cooler 15 for instance at a temperature of about +30° C. and at a pressure of about 31 bars flows through the flow passage-way 31*a* of the first condensing heat exchanger 16′*a* to be partially liquefied therein through heat exchange with the auxiliary or heavy refrigerating fluid. The main refrigerating fluid thus partially condensed leaves the first condensing heat exchanger 16′*a* for instance at a temperature of about −30° C. and at a pressure of about 30 bars to be fed to the separator 51 performing the separation of its gaseous and liquid phases, respectively. Its liquid phase then flows through the flow passage-way 53 of the heat exchanger 27 to be sub-cooled therein for instance down to a temperature of about −70° C. and at a pressure of about 28 bars and then it flows through the cryogenic hydraulic turbine 55 to be expanded therein (thereby inducing or sustaining the continuous rotary motion of the turbine possibly together with attendant drive of the rotary machine 56) while having thus for instance its temperature lowered to about −75° C. and its pressure lowered to about 3.2 bars. This liquid phase thus expanded possibly undergoes an additional expansion by flowing through the (optional) expansion valve 58 and then joins the vaporized portion of the main refrigerating fluid leaving the heat exchanger 3 through the outlet port 24 before the total fluid flow rate passes through the passageway 29 of the heat exchanger 27 to vaporize fully therein before being drawn in again and recompressed by the compressor set 12. The gaseous phase separated in the separator 51 flows through the flow passage-way 31*b* of the second condensing heat exchanger 16′*b* to be partially liquefied therein through heat exchange with the auxiliary refrigerating fluid so that it issues from this second heat exchanger 16′*b* for instance at a temperature of about −70° C. and at a pressure of about 29 bars to reach the separator 26 already described previously; thus the subsequent evolution of this second portion of the main refrigerating fluid would correspond to what has already been described with reference to the embodiment shown on FIG. 3. It should however be pointed out that the sub-cooled liquid fraction of the main refrigerating fluid which flows through the hydraulic turbine 19*b* enters the latter for instance at a temperature of about −140° C. and at a pressure of about 28 bars to flow out thereof in the expanded condition for instance at a temperature of about −143° C. and at a pressure of about 3.5 bars whereas the sub-cooled liquid fraction of the main refrigerating fluid which flows through the hydraulic turbine 19*a* enters the latter for instance at a temperature of about −160° C. and at a pressure of about 27 bars to flow out thereof in the expanded state for instance at a temperature of about −163° C. and at a pressure of about 2.7 bars; the portion of the main refrigerating fluid to be totally vaporized in the heat exchanger 3 issues therefrom through the outlet port 24 preferably at the same temperature (of about −75° C.) and pressure (of about 3.2 bars) as the expanded portion of main refrigerating fluid coming through the duct 57 to mix therewith at the point of junction 59. The total main refrigerating fluid then flows as already stated through the passage-way 29 of the heat exchanger 27 to be fully vaporized therein while streaming therein in the direction opposite to the direction of circulation of the fluids in the passage-way 28 and the flow passage-way 53, respectively, of the same exchanger 27 while being in heat exchange therewith in order to cool the gas to be liquefied in the passage-way 28 and to sub-cool the liquid fraction of the main refrigerating fluid in the flow passage-way 53. The vaporized total refrigerating fluid thus reheated in the heat exchanger 27 for instance up to a temperature of about +10° C. at a pressure of about 3 bars is drawn in again and recompressed by the compressor set 12. It is thus found that in this embodiment according to FIG. 4 the main refrigerating fluid is split into two portions the larger one of which flows through the heat exchanger 3.

In the closed circuit of the auxiliary or heavy refrigerating fluid 3, the compressed auxiliary refrigerating fluid issuing in the fully condensed or liquid state from the condenser 38 for instance at a temperature of about +30° C. and at a pressure of about 40 bars flows through the flow passageway 42*a* of the first heat exchanger 16′*a* to be sub-cooled therein for instance down to a temperature of about −30° C. and at a pressure of about 39 bars. When leaving this first heat exchanger 16′*a* the main refrigerating fluid thus sub-cooled once is divided up at the point 61 of the duct 37′ into two portions. One of these two portions flows through the hydraulic turbine 44*a* to be expanded therein (thereby inducing or sustaining a continuous rotary motion of the turbine possibly together with attendant drive of the rotary machine 45*a*) while having thus for instance its temperature lowered to about −33° C. and its pressure lowered to about 10.2 bars; this portion thus expanded possibly undergoes an additional expansion through the (optional) expansion valve 50*a* before flowing through the passage-way 47*a* of the first heat exchanger 16′*a* to keep vaporizing therein by circulating in a direction opposite to the common direction of flow of the respective fluids in the flow passage-ways 31*a* and 42*a*, while being in heat exchange therewith so as to partially liquefy the main refrigerating fluid in the flow passage-way 31*a* and to sub-cool the liquid auxiliary refrigerating fluid in the flow passage-way 42*a*. The vaporized portion of the auxiliary refrigerating fluid thus reheated in the first heat exchanger 16′*a* leaves the latter for instance at a temperature of about +25° C. and at a pressure of about 10 bars to be drawn in again by the second compressor 32*a*$_2$. The other portion of the liquid auxiliary refrigerating fluid in the duct 37′, already sub-cooled once then flows through the flow passage-way 42*b* of the second heat exchanger 16′*b* to be still further sub-cooled therein for instance down to a temperature of about −70° C. and at a pressure of about 38 bars before flowing through the hydraulic turbine 44*b* for being expanded therein (thereby inducing or sustaining the continuous rotary motion of the turbine possibly together with attendant drive of the rotary machine 45*b*) while having thus for instance its temperature lowered to about −73° C. and its pressure lowered to about 2.2 bars. This portion thus expanded possibly undergoes an additional expansion by flowing through the (optional) expansion valve 50*b* and then flows through the passage-way 47*b* of the second heat exchanger 16′*b* to be fully vaporized therein while streaming therein in a direction opposite to the common direction of circulation of the fluids in the flow passage-ways 31*b* and 42*b*, respectively, while being in heat exchange therein with these fluids, so as to partially liquefy the main refrigerating fluid in the flow passage-way 31*b* and to additionally sub-cool the liquid auxiliary refrigerating fluid in the flow passage-way 42*b*. This vaporized portion of the auxiliary refrigerating fluid thus reheated by its flow through the second heat exchanger 16′*b* leaves the passage-way 47*b* of the latter through the outlet port 48*b* while being for instance at a temperature of about −33° C. and at a pressure of about 2 bars to reach the duct 49*b* at the suction port of the first compressor 32*a*$_1$ in order to be recompressed therein in the gaseous state and then cooled by flowing through the intermediate cooler 34′ before joining at the point of junction 62 the vaporized portion of the auxiliary refrigerating fluid issuing from the first heat exchanger 16′*a* through the duct 49*a*, the total flow rate of the gaseous auxiliary refrigerating fluid thus restored being then drawn in again and recompressed by the second compressor 32*a*$_2$. The auxiliary refrigerating fluid thus compressed in the gaseous state and then partially liquefied in the condenser 34 issues from the latter for instance at a temperature of about +30° C. and at a pressure of about 20 bars before being fed into the separator 35.

It should be pointed out that at least one or each one of the passage-ways 29 (circuit 2) and 47*a*, 47*b* (circuit 3) where the refrigerating fluids involved are fully vaporized in the confined state could be replaced by a jet-producing spray distribution member of a type comparable to the member 21*a* or 21*b*.

The system shown in FIG. 5 makes use again of a single closed circuit or refrigeration cycle 2 for a single refrigerating fluid which is here divided into four fractional portions respectively cooled previously through heat exchange with parts of themselves in the vaporized state and only the last fractional portion of which is used for the liquefaction and subsequent sub-cooling of the gas to be liquefied. The circuit 1 of the gas to be liquefied as well as that portion of the circuit 2 of the refrigerating fluid which is used for the preliminary cooling, the liquefaction and the sub-cooling of the gas to be liquefied are substantially equivalent to the corresponding portions, respectively, of the circuits 1 and 2 shown on FIG. 3 in particular with respect to the heat exchangers 3 and 27. The outstanding particular features of the circuit of refrigerating fluid 2 are the following.

The compressor set 12 for the gaseous refrigerating fluid consists of three compressors 12*a*$_1$, 12*a*$_2$ and 12*b*, respectively, forming a like number of successive compression stages and which may be driven either separately through individual prime movers or collectively for at least two or all of them by means of one single common prime mover, the collectively driven compressors being then mechanically coupled to each other. The outlet or delivery port of the second compressor 12*a*$_2$ is connected through a pipe-line 63 to the inlet of a condenser 64 which advantageously is of the type operating with an outer cooling fluid consisting for instance of water or air and the outlet of which is connected to a phase separator 65. The gaseous phase collecting space of the separator 65 is connected through a pipe-line 66 to the suction port of the third compressor 12*b* the outlet or discharge port of which is connected through a duct 67 to the inlet of a condenser 68 the outlet of which is connected to a phase separator 69. The liquid phase collecting space of the separator 65 is connected through a duct 70 to the suction port of a circulating and accelerating pump 71 the delivery port of which is connected to the delivery duct 67 of the third compressor 12*b* at an intermediate branch point 72 located upstream of the condenser 68. There are moreover provided two successive condensing heat exchangers 73*a* and 73*b* for the refrigerating fluid which may consist either of two physically distinct units or be integrated into a same body 73 forming an enclosing shell or casing common to both aforesaid condensing heat exchangers (as shown on FIG. 5).

The condensing heat exchanger 73*a* contains at least two flow passage-ways 74 and 75 extending in generally parallel relation to a same direction. The upstream ends of the flow passage-ways 74 and 75 are connected respectively through ducts 76 and 77 to the gaseous phase collecting space and to the liquid phase collecting space of the separator 69. The downstream end of the flow passage-way 75 is connected through a pipe-line 78 to the inlet of a cryogenic hydraulic expansion turbine 79 (having its shaft possibly coupled mechanically to a rotary machine 80) located outside of the heat exchanger 73*a*. The outlet of the turbine 79 is connected by a pipe-line 81 possibly through an additional expansion valve 82 to a distribution member 83 placed for instance in the shell of the heat exchanger 73 towards the end of the heat exchanger 73*a* on the side of the downstream ends of the flow passage-ways 74 and 75. This distribution member is for instance of the jet-producing spray distributor type pointing towards the flow passage-ways 74 and 75 and opening directly into the inner space of the shell of the heat exchanger 73*a*. The downstream end of the flow passage-way 74 is connected through a duct 84 to a phase separator 51′ positioned outside of the heat exchangers 73 and the gaseous phase and liquid phase collecting spaces of which are connected respectively through the ducts 85 and 86 to the upstream ends of at least two flow passage-ways 87, 88 extending within the heat exchanger 73*b* in general parallel relation to a common direction. The downstream end of the flow passage-way 87 is connected through a pipe-line 89 to the outer phase separator 26 already described previously with respect to its corresponding downstream mounting configuration. The downstream end of the flow passage-way 88 is connected through a pipe-line 90 to the inlet of a cryogenic hydraulic expansion turbine 91 (having its shaft possibly coupled mechanically to a rotary machine 92) which is outside of the heat exchanger 73*b*. The outlet of the turbine 91 is connected by a pipe-line 93 possibly through an additional expansion valve 94 to a distribution member 95 for instance located within the heat exchanger 73*b* towards that end thereof which is placed towards the downstream ends of the flow passage-ways 87 and 88. This distribution member 95 is for instance of the jet-producing spray distributor type oriented towards the flow passage-ways 87 and 88 and opening into the inner space of the shell 73 common to both heat exchangers 73*a* and 73*b* and the inner space of which thus is common to both of the latter. The exchanger 73 instead of being of the type provided with a nest, cluster or bundle of coiled tubes, may be of the plate construction type and in such a case one or each one of the distribution members 83 and 95 may consist of at least one passage-way extending in substantially parallel relation to the flow passage-ways 74, 75 or 87, 88 which are associated therewith.

The common inner space defined by the shell 73 communicates at its end located towards the upstream ends of the flow passage-ways 74 and 75 through a duct 96 with the suction port of the second compressor $12a_2$. The duct 25, extending from the outstream end of the coil of tubing or piping 29 of the heat exchanger 27 leads to the suction port of the first compressor $12a_1$ the outlet or delivery port of which is also connected to the suction port of the second compressor $12a_2$ by means of a duct 97 and through an intermediate or inter-stage cooler 98 for instance of the type operating with an outer cooling fluid consisting for instance of water or air and the outlet of which is connected to the duct 96 at a branch point 99 thereof.

The operation of the circuit 1 of gas to be liquefied is similar to that which has been described with reference to FIG. 3 but with the following different numerical values of temperature and pressure by way of example:

- at the inlet of the duct 4, the gas to be liquefied GN is at a temperature of about +20° C. and at a pressure of about 45 bars;
- at the inlet of the heat exchanger 3 this gas is at a temperature of about −60° C. and at a pressure of about 44 bars;
- at its outlet of the heat exchanger 3 the sub-cooled liquefied gas is at a temperature of about −160° C. and at a pressure of 41 bars.

The outstanding operating features of the cycle of refrigerating fluid 2 are the following: the total gaseous refrigerating fluid is drawn in by the second compressor $12a_2$ to be recompressed in the gaseous state and then partially liquefied in the condenser 64 for instance at a temperature of about +30° C. and at a pressure of about 20 bars. This partially liquefied fluid then undergoes a phase separation within the separator 65; its gaseous phase is drawn in by the third compressor 12*b* to be recompressed in the gaseous state whereas its liquid phase is drawn in and compressed in the liquid state by the pump 71 which will move it to join at 72 the compressed gaseous phase delivered by the compressor 12*b*. This mixture of gaseous and liquid phases, respectively, the flows through condenser 68 to undergo an additional partial liquefaction therein for instance at a temperature of about +30° C. and at a pressure of about 35 bars before undergoing a new phase separation in the separator 69. The liquid phase thus separated flows through the flow passage-way 75 of the first heat exchanger 73*a* to be sub-cooled therein through heat exchange with a vaporized portion of itself whereas the gaseous phase flows through the flow passage-way 74 of the same heat exchanger to be cooled therein until partial liquefaction through heat exchange with said same vaporized portion. The sub-cooled liquid phase issuing from the flow passage-way 75 for instance at a temperature of about −20 C. and at a pressure of about 34 bars flows through the hydraulic turbine 79 to be expanded therein (thereby inducing or sustaining the continuous rotary motion of the turbine possibly together with attendant drive of the rotary machine 80). The fluid thus expanded possibly undergoes an additional expansion through the (optional) expansion valve 82 before reaching the distribution member 83 of the heat exchanger 73*a* wherein it keeps vaporizing while streaming in the direction opposite to the common direction of circulation of the respective fluids in the flow passage-ways 74 and 75 so as to provide through heat exchange with these fluids for the partial liquefaction of the gaseous phase in the flow passage-way 74 and for the sub-cooling of the liquid phase in the flow passage-way 75.

The partially liquefied fraction issuing from the flow passage-way 74 for instance at a temperature of about −15° C. and at a pressure of about 35 bars undergoes in the separator 51′ a separation of its respective gaseous and liquid phases which then flow through the flow passage-ways 87 and 88, respectively, of the second heat exchanger 73*b*. In the flow passage-way 87 the gaseous phase is partially liquefied and in the flow passage-way 88 the liquid phase is sub-cooled through heat exchange with a vaporized portion of the latter. The sub-cooled liquid fraction leaves the flow passage-way 88 for instance at a temperature of about −60° C. and at a pressure of about 33 bars to thereafter flow through the hydraulic turbine 91 for being expanded therein (thereby inducing or sustaining the continuous rotary motion of the turbine possibly together with the attendant drive of the rotary machine 92). The fraction thus expanded, having for instance its temperature lowered to about −63° C. and its pressure lowered to about 7.2 bars possibly undergoes an additional expansion through the (optional) expansion valve 94 before reaching the distribution member 95 of the exchanger 73*b* where it keeps vaporizing while streaming in the direction opposite to the common direction of circulation of the respective fluids in the flow passage-ways 87 and 88, in order to carry out a heat exchange sub-cooling the liquid fluid in the flow passage-way 88 and partially liquefying the gaseous fluid in the flow passage-way 87. The fraction of refrigerating fluid thus vaporized in the heat exchanger 73*b* then flows into the exchanger 73*a* for mixing therein with the vaporized portion of the refrigerating fluid. All the vaporized portions of the refrigerating fluid originating from the liquid phases, respectively, separated in the separators 69 and 51′ and thus reheated through heat exchange with the flow passage-ways 74, 75 and 87, 88 leave the heat exchanger 73 through the duct 96 for instance at a temperature of about +20° C. and at a pressure of about 6.8 bars.

The partially liquid fraction in the flow passage-way 87 leaves the latter through duct 89 for instance at a temperature of about −60° C. and at a pressure of about 33 bars to reach the phase separator 26 and thereafter evolve as previously described in particular with reference to the embodiments according to FIGS. 2 to 4 but with different numerical temperature and pressure values given by way of example only hereinafter:

at the inlet of the turbine 19*b* the sub-cooled liquid is at a temperature of about −130° C. and at a pressure of about 31 bars whereas at the outlet of this turbine the expanded fluid is at a temperature of about −133° C. and at a pressure of about 1.8 bar;

at the inlet of the turbine 19*a* the sub-cooled liquid fluid is at a temperature of about −160° C. and at a pressure of about 30 bars whereas at the outlet of this turbine the expanded fluid is at a temperature of about −163° C. and at a pressure of about 2 bars;

the vaporized fluid issuing from the port 24 of the casing of the heat exchanger 23 is at a temperature of about −65° C. and at a pressure of about 1.5 bar whereas at its outlet from the passage-way 29 of the heat exchanger 27 it is at a temperature of about +10° C. and at a pressure of about 1.3 bar in the duct 25 for being drawn in again under these conditions and recompressed by the first compressor $12a_1$.

The fraction of the gaseous refrigerating fluid thus compressed in the first compressor $12a_1$ is delivered through the intermediate or inter-stage cooler 98 wherefrom it issues substantially at the same temperature and pressure as the fraction of the gaseous fluid fed by the duct 96 and then both fractions will join at the point 99 so that the total gaseous refrigerating fluid is thus drawn in again by the second compressor $12a_2$.

The various embodiments described and shown on FIGS. 1 to 5, respectively, of the drawings obviously are part of the invention on account of their particular structures.

The invention is of course not at all limited to the embodiments described and shown which have been given by way of illustrative examples only. In particular it comprises all the means constituting technical equivalents of the means described as well as their combinations if same are carried out according to its gist and used within the scope of the appended claims.

What is claimed is:

1. A method of refrigerating at least one fluid to be cooled down to a low temperature, in particular lower than −30° C., through heat exchange with at least one refrigerating fluid, each refrigerating fluid consisting of a mixture of several different components substances evolving according to a closed-loop cooling cycle while undergoing successively therein: at least one compression in the gaseous state, at least one pre-cooling with at least partial high pressure condensation, at least one self-refrigeration with sub-cooling of at least one liquid fraction through heat exchange in counter-current relationship with the low pressure vapor originating from at least the same sub-cooled liquid fraction of said same refrigerating fluid, at least one expansion of at least said same low pressure fraction and at least one conversion of said vapor which is recompressed thereafter, wherein the improvement consists in the step of reducing, for a same amount of treated products, the power absorbed by said compression by performing at least one aforesaid expansion dynamically so as to produce an outer mechanical work.

2. A method according to claim 1, operating with an aforesaid fluid to be cooled which is a gas to be liquefied flowing in an open-loop circuit while being at least partially liquefied at high pressure and at least its liquid phase possibly sub-cooled previously is expanded to a low pressure, wherein said expansion is carried out dynamically so as to produce an outer mechanical work.

3. A method according to claim 2, further comprising the step of recovering said outer mechanical work to generate consumable converted energy or a useful technical effect.

4. A method according to claim 2, wherein at least one aforesaid expansion is carried out to a pressure lower by at least 15 bars than said high pressure.

5. A method according to claim 2, wherein each motive power generating dynamic expansion is followed by an additional passive expansion without producing outer work so as to keep the fluid concerned in the monophasic liquid state while avoiding its vaporization at too low a pressure in said dynamic expansion.

6. A method according to claim 2, consisting in matching the nature and/or the composition of at least one refrigerating fluid with the number of dynamic expansions.

7. A method according to claim 1, further comprising the step of recovering said outer mechanical work to generate either consumable converted energy or a useful technical effect.

8. A method according to claim 1, wherein at least one aforesaid expansion is performed to a pressure lower by at least 15 bars than said high pressure.

9. A method according to claim 1, wherein each motive power generating dynamic expansion is followed by an additional passive expansion without generation of outer work so as to keep the fluid involved in the monophasic liquid state to avoid its vaporization at too low a pressure in said dynamic expansion.

10. A method according to claim 1, consisting in adapting the nature and/or the composition of at least one refrigerating fluid to the number of dynamic expansions.

11. An apparatus for refrigerating at least one fluid to be cooled down to a low temperature, comprising: on the one hand an in particular open circuit for a gas to be liquefied including at least the following elements: at least one passage-way for the fluid to be cooled in at least one heat exchanger through which said refrigerating fluid is flowing; at least one member for expanding the liquid phase of said liquefied gas; as well as on the other hand a closed circuit for at least one refrigerating fluid, each circuit including at least the following elements: at least one compressor for the gaseous refrigerating fluid, at least one cooler and/or condenser; and at least one aforesaid heat exchanger containing at least one flow passage-way for the at least partially liquefied refrigerating fluid and at least one passage-way for the vaporized refrigerating fluid extending in a direction opposite to each aforesaid flow passage-way while being connected at its upstream end to the downstream end of said flow passage-way and having inserted therein at least one member for expanding at least one fraction of the liquid phase of said refrigerating fluid, whereas its downstream end is connected to the suction side of said compressor, wherein the improvement consists in that at least one aforesaid expansion member consists of at least one cryogenic power-absorbing turbo-machine having at least one turbine operating with a substantially incompressible, in particular hydraulic fluid.

12. An apparatus according to claim 11 wherein the fluid outlet of at least one aforesaid turbo-machine is connected to an additional expansion valve.

13. An apparatus according to claim 12, wherein at least one aforesaid turbo-machine has its shaft operatively coupled to at least one work-producing or electric power generating machine.

14. An apparatus according to claim 11 wherein at least one afoesaid turbo-machine has its shaft operatively coupled to at least one work-producing or electric power generating machine.

* * * * *

UNITED STATES PATENT AND TRADEMARK OFFICE

CERTIFICATE OF CORRECTION

PATENT NO. : 4,334,902

DATED : June 15, 1982

INVENTOR(S) : Henri Paradowski

It is certified that error appears in the above—identified patent and that said Letters Patent is hereby corrected as shown below:

Column 2, line 25, "to" should be --be--.

Column 4, line 40, "next" should be --nest--.

Column 5, line 16, "piper-line" should be -- pipe-line --.

Column 19, line 55, "the" should be --then--.

Signed and Sealed this

*Nineteenth* Day of *October 1982*

[SEAL]

*Attest:*

GERALD J. MOSSINGHOFF

*Attesting Officer*

*Commissioner of Patents and Trademarks*